US010364131B2

(12) United States Patent
Nunley et al.

(10) Patent No.: US 10,364,131 B2
(45) Date of Patent: Jul. 30, 2019

(54) DOUBLE SYNTHETIC SLING

(71) Applicant: Actuant Corporation, Menomonee Falls, WI (US)

(72) Inventors: Brooks Nunley, Friendswood, TX (US); Vincent Martinez, Bergen (NO)

(73) Assignee: Actuant Corporation, Menomonee Falls, WI (US)

( * ) Notice: Subject to any disclaimer, the term of this patent is extended or adjusted under 35 U.S.C. 154(b) by 91 days.

(21) Appl. No.: 15/322,081

(22) PCT Filed: Jun. 23, 2015

(86) PCT No.: PCT/US2015/037280

§ 371 (c)(1),
(2) Date: Dec. 23, 2016

(87) PCT Pub. No.: WO2015/200387

PCT Pub. Date: Dec. 30, 2015

(65) Prior Publication Data

US 2017/0144864 A1 May 25, 2017

Related U.S. Application Data

(60) Provisional application No. 62/015,794, filed on Jun. 23, 2014.

(51) Int. Cl.
*B66C 1/12* (2006.01)
*D07B 1/18* (2006.01)

(52) U.S. Cl.
CPC ..... *B66C 1/122* (2013.01); *B66C 1/12* (2013.01); *D07B 1/18* (2013.01)

(58) Field of Classification Search
CPC .. B66C 1/122; B66C 1/12; B66C 1/18; D07B 1/18; D07B 1/02
(Continued)

(56) References Cited

U.S. PATENT DOCUMENTS 1,703,269 A 2/1929 McClinktock
2,406,270 A * 8/1946 Torell ..... B66C 1/12 24/122.6
(Continued)

FOREIGN PATENT DOCUMENTS

DE 2416776 A1 * 10/1975 ..... B66C 1/12
FR 2678917 A1 * 1/1993 ..... B66C 1/12
(Continued)

OTHER PUBLICATIONS

International Search Report for Application No. PCT/US2015/037280 dated Sep. 15, 2015 (2 pages).
(Continued)

*Primary Examiner* — Gabriela M Puig
(74) *Attorney, Agent, or Firm* — Michael Best & Friedrich LLP

(57) ABSTRACT

A synthetic load transfer assembly. The assembly generally includes a load portion connectable to a connection point (e.g., a shackle) of a load, a first lifting portion connectable to a first lifting device (e.g., a crane of a vessel, a winch of a production system, etc.), and a second lifting portion connectable to a second lifting device (e.g., another crane of the vessel, a crane of another vessel, another winch of the production system, etc.). Load bearing portions connect the load portion to the respective lifting portions. The portions are formed of one or more synthetic materials.

17 Claims, 11 Drawing Sheets

(58) Field of Classification Search
USPC ..... 294/74; 57/237
See application file for complete search history.

(56) References Cited

U.S. PATENT DOCUMENTS

| | | | | | |
|---|---|---|---|---|---|
| 2,435,088 | A | * | 1/1948 | Mazzella | B66C 1/12 87/8 |
| 2,448,463 | A | | 8/1948 | Robbins | |
| 2,491,767 | A | * | 12/1949 | Robbins | B66C 1/12 87/8 |
| 3,899,206 | A | * | 8/1975 | Miura | B66C 1/18 294/74 |
| 4,240,659 | A | * | 12/1980 | St. Germain | B66C 1/12 294/74 |
| 5,727,833 | A | | 3/1998 | Coe | |
| 5,901,632 | A | * | 5/1999 | Ryan | B65H 69/06 57/22 |
| 6,149,215 | A | * | 11/2000 | Balogh | B66C 1/18 294/74 |

FOREIGN PATENT DOCUMENTS

| | | | | | |
|---|---|---|---|---|---|
| FR | 2820133 | A1 | * | 8/2002 | B66C 1/12 |
| GB | 755633 | A | * | 8/1956 | B66C 1/12 |
| JP | 02152895 | A | * | 6/1990 | |

OTHER PUBLICATIONS

Samson Rope, "Cascade & Chinook Case Study," Jan. 2011, 2 pages, Retrieved from the Internet <URL: http://www.samsonrope.com/Documents/Case%20Studies/CS_Cascade%20Chinook_JAN2011_HR.pdf>.

PCT/US2015/037280 International Preliminary Report on Patentability and Written Opinion of the International Searching Authority dated Dec. 27, 2016 (6 pages).

Examination Report issued from the European Patent Office for related Application No. 15735810.2 dated Aug. 7, 2018 (5 pages).

Examination Report issued from the Australian Patent Office for related Application No. 2015280078 dated Feb. 22, 2019 (5 pages).

* cited by examiner

DOUBLE SYNTHETIC SLING

RELATED APPLICATION

The present application claims priority to U.S. Provisional Patent Application No. 62/015,794, filed Jun. 23, 2014, the entire contents of which is hereby incorporated by reference.

FIELD

This invention generally relates to a load transfer assembly and, more particularly, a synthetic load transfer assembly.

SUMMARY

Load transfer operations are routinely performed subsea when installing equipment such as a steel catenary riser (SCR), a pipeline end termination (PLET), a pipeline end manifold (PLEM)/manifold, etc. Currently, the industry uses a hybrid solution including steel hardware (shackles, tri-plates, etc.) and synthetic slings (Plasma®, Selantic). Examples of these solutions are shown in FIGS. 1-2. However, deeper water and increasing safety factors have caused traditional rigging to become very large, limiting the "height under hook" of installation vessels and making the rigging systems heavy and difficult to handle.

As shown in FIG. 1, an existing system for PLEM deployment may include a sling 1 (e.g., an eye-to-eye sling), metal (e.g., steel) wide body shackles 2, hooks 3, 7, grommets 4, 6, and a metal (e.g., steel) tri-plate 5 connecting the grommets 4, 6 (for connection to $LD_1$ and $LD_2$) to a connection point C of a load (not shown).

As shown in FIGS. 2A-2D, another existing system for PLEM deployment includes a sling 1 (e.g., a round sling), metal (e.g., steel) wide body shackles 2, slings 4', 6', and a metal (e.g., steel) tri-plate 5 connecting the slings 4', 6' to a connection point C of a load L. FIG. 2B illustrates a spreader bar assembly of the connection point C while FIGS. 2C-2D illustrate in more detail the connection at the tri-plate 5 and at LD1 (for deployment), respectively.

The present invention may provide a synthetic solution for performing subsea load transfer operations (lift or deployment) from crane hook to structure, using a combination of synthetic slings (e.g., two slings) bound together. The synthetic solution eliminates the steel components from hook to structure, particularly the tri-plate and associated shackles, reducing weight, size, installation time, and potentially overall cost of the rigging system without jeopardizing required Factor of Safety.

In one independent aspect, a synthetic load transfer sling assembly may generally include a load portion directly connectable to a load; a first lifting portion directly connectable to a first lifting device; a first load bearing portion connected between the load portion and the first lifting portion; a second lifting portion directly connectable to a second lifting device; and a second load bearing portion connected between the load portion and the second lifting portion. The load portion, the first lifting portion, the first load bearing portion, the second lifting portion and the second load bearing portion may each be formed of a synthetic material.

In another independent aspect, a synthetic load transfer sling assembly may generally include a synthetic first sling including a first load portion directly connectable to a connection point of a load, a first lifting portion directly connectable to a first lifting device, and a first load bearing portion connected between the first load portion and the first lifting portion; and a synthetic second sling including a second load portion directly connectable to the connection portion of the load, a second lifting portion directly connectable to a second lifting device, and a second load bearing portion connected between the second load portion and the second lifting portion.

In yet another independent aspect, a synthetic load transfer sling assembly may generally include a synthetic first sling; a synthetic second sling; and a cover encompassing the first load portion and the second load portion.

In a further independent aspect, a synthetic load transfer sling assembly may generally include a synthetic first sling; a synthetic second sling; and a whipping connecting the first load bearing portion and the second load bearing portion.

Independent features and independent advantages of the invention will become apparent to those skilled in the art upon review of the detailed description, claims and drawings.

DETAILED DESCRIPTION

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Figure 1:
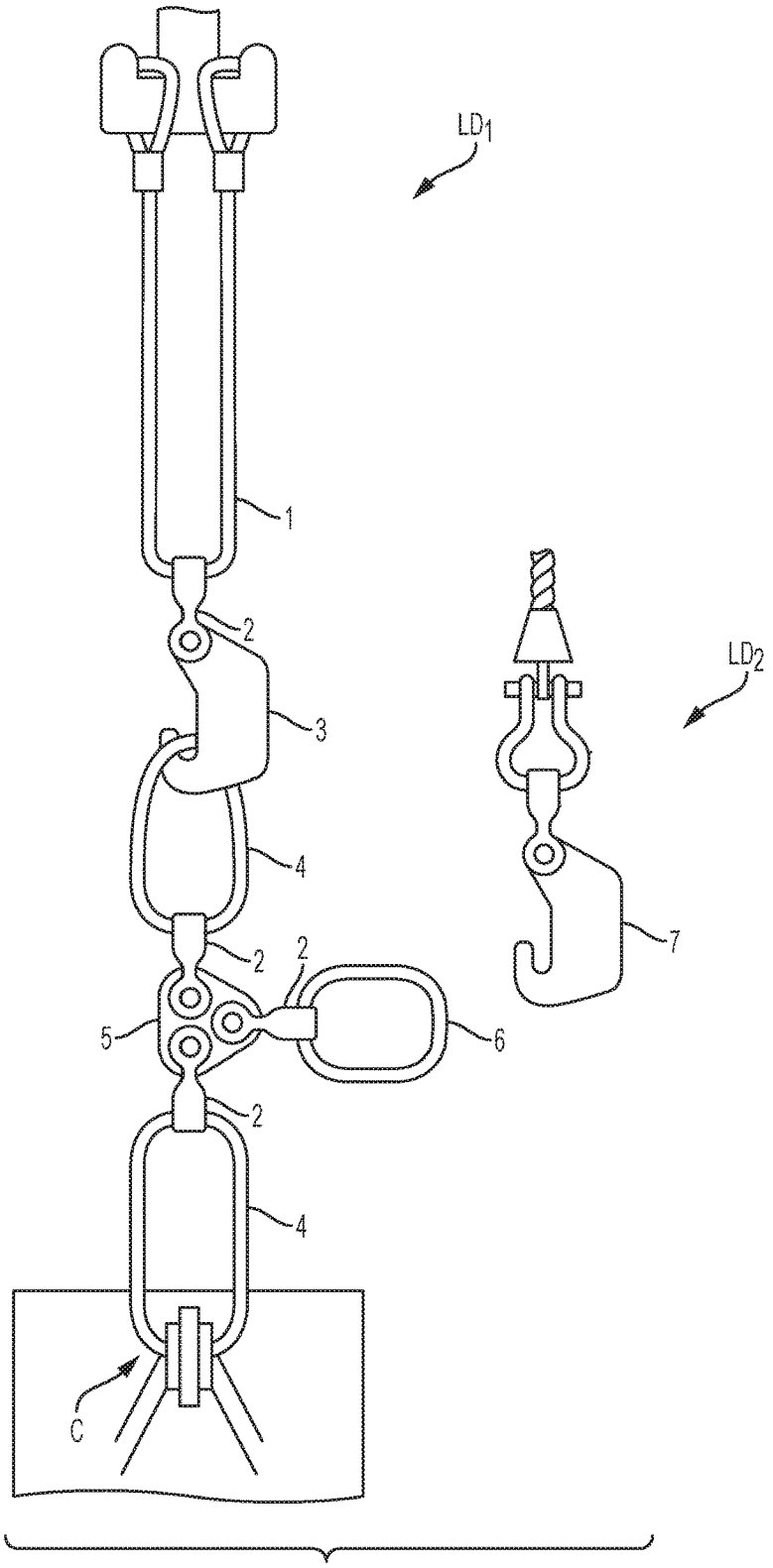
FIG. 1 PRIOR ART
FIG. 1 illustrates an example of an existing load transfer rigging system.
Figure 2A:
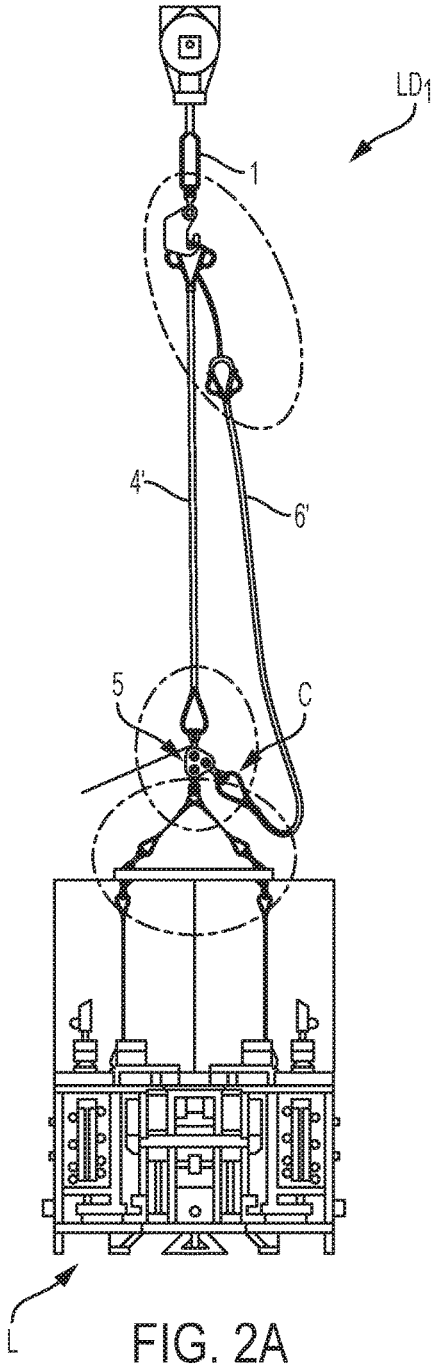
FIG. 2A PRIOR ART
FIGS. 2A-2D illustrate another example of an existing load transfer rigging system.
Figure 2B:
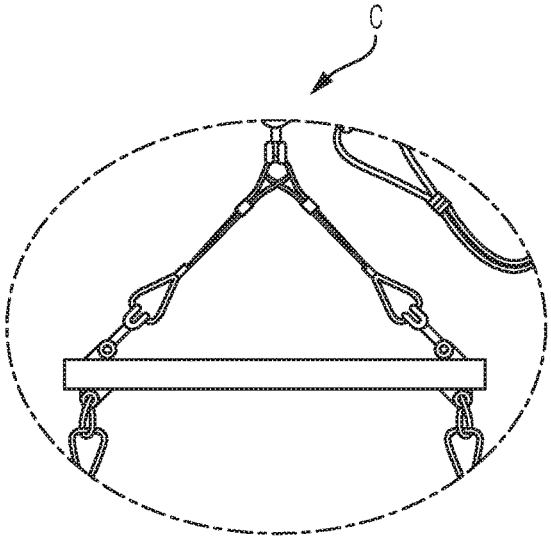
FIG. 2B PRIOR ART
Figure 2C:
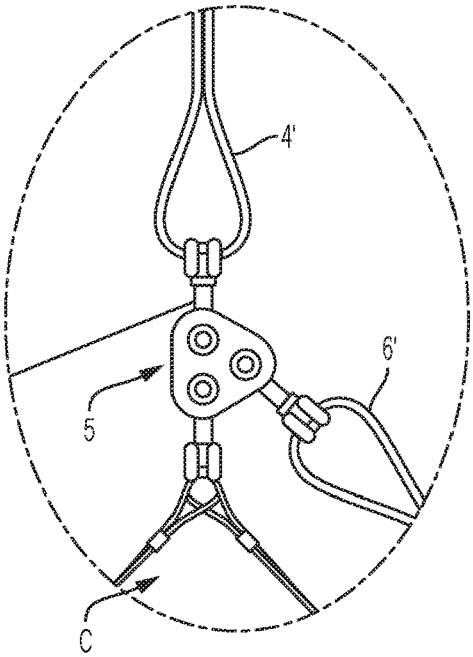
FIG. 2C PRIOR ART
Figure 2D:
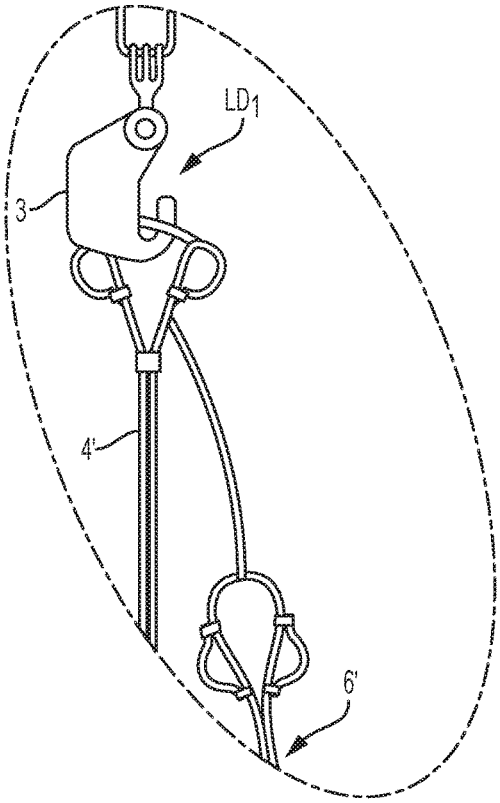
FIG. 2D PRIOR ART
Figure 3:
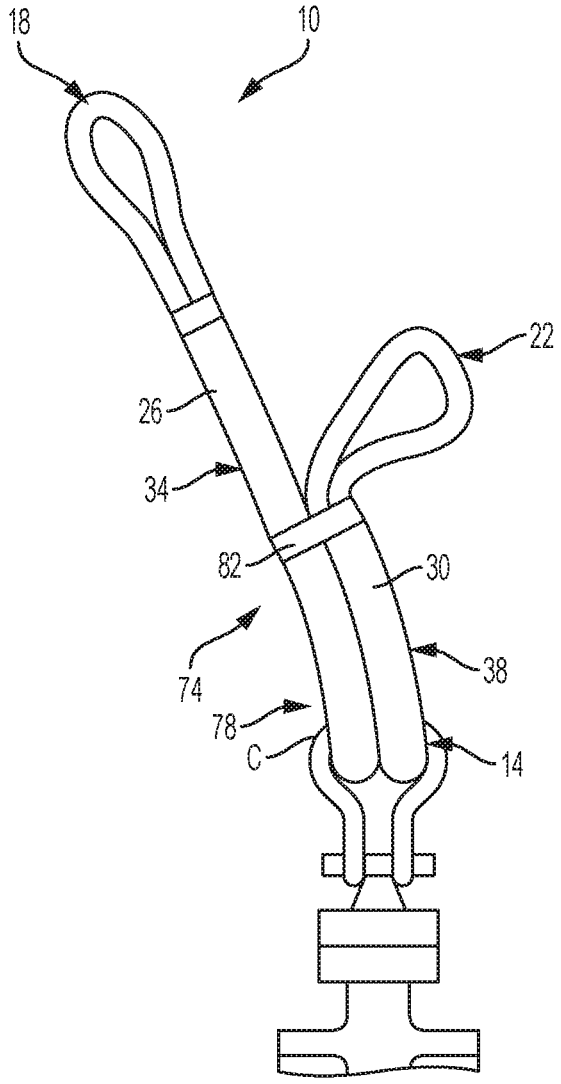
FIG. 3 illustrates a synthetic load transfer assembly.
Figure 4:
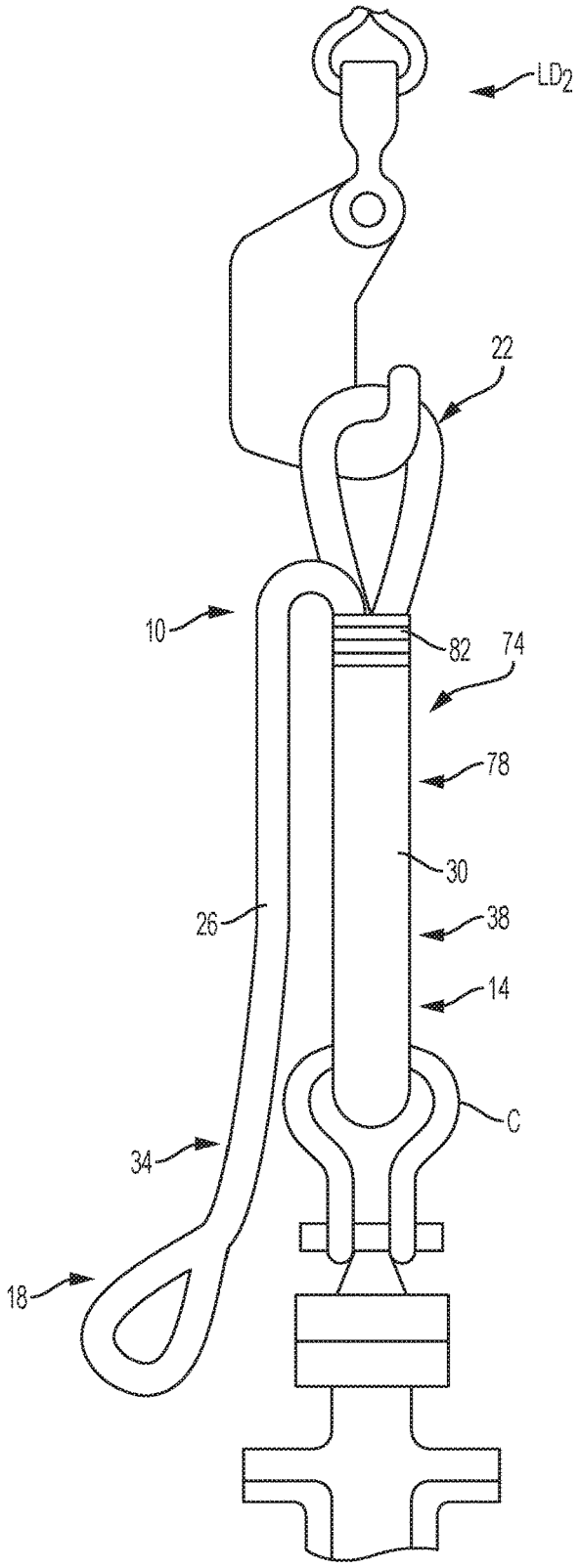
FIG. 4 illustrates the assembly shown in FIG. 3 after transfer of the load.
Figure 5:
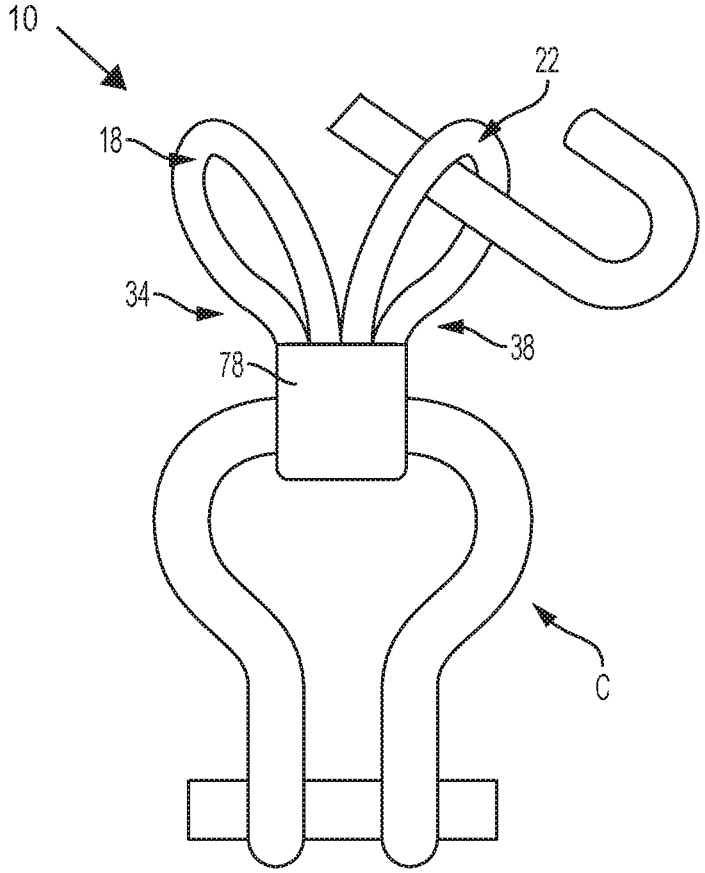
FIG. 5 is a schematic view of a synthetic load transfer assembly

FIGS. 3-8 illustrate a synthetic load transfer assembly 10. In its simplest form, the assembly is a "synthetic only" assembly, in which the metallic material/structure (e.g., the steel hardware (shackles, tri-plates, etc.)) of current solutions (see FIGS. 1-2) is substantially eliminated.

"Synthetic" is understood to mean that the assembly 10 substantially does not include any metallic material/structure bearing a portion of the load. While not included in the illustrated construction, in other constructions (not shown), a synthetic load transfer assembly may include metallic material/structure which does not bear the load (at least during normal operations) and still be considered a "synthetic" assembly. Also, as discussed below, structure of the lifting device(s) and/or associated with the load (e.g., the crane block, hooks, yokes, shackles, etc.) may include metallic material/structure without changing the nature of a "synthetic" assembly (see, e.g., FIGS. 3-4).

The assembly 10 generally includes a load portion 14 connectable to a connection point C (e.g., a shackle) of a load L, a first lifting portion 18 connectable to a first lifting device $LD_1$ (e.g., a crane of a vessel, a winch of a production system, etc.), and a second lifting portion 22 connectable to a second lifting device $LD_2$ (e.g., another crane of the vessel, a crane of another vessel, another winch of the production system, etc.). Load bearing portions 26, 30 connect the load portion 14 to the lifting portions 18, 22, respectively. The portions 14-30 are formed of one or more synthetic materials.

In the illustrated construction, the assembly 10 includes synthetic slings 34, 38 providing the portions 14-30. Each sling 34, 38 is formed to have a pair of eyes 42, 46 connected by a leg section 50. In the illustrated construction, the slings 34, 38 are each folded generally in half with the section at the fold (e.g., the intermediate portion of the leg section 50) providing one of the load portion 14 and the lifting portion 18, 22 and the eyes 42, 46 providing the other of the load portion 14 and the lifting portion 18, 22.

In the illustrated construction (see FIGS. 6A-6D), the slings 34, 38 are "basketed" on the load L. In this configuration, the load portion 14 of one sling (e.g., the sling 34) is centered on the connection point C of the load L with a portion of the load portion 14 of the other sling (e.g., the sling 38) on each side. For example, the intermediate portion of the leg section 50 of the sling 34 provides its load portion 14 with one eye 42, 46 of the sling 38 on either side. The load portions 14 of both slings 34, 38 are thus both generally centered on the connection point C.

In other constructions (not shown), the orientation of the folded slings 34, 38 may be reversed. In still other constructions (not shown), the orientation of the folded slings 34, 38 may be the same—with the eyes 42, 46 of the sling 34 being centered on the connection point C and one eye 42, 46 of the sling 38 being on either side.

In yet other constructions (not shown), a sling(s) (e.g., the sling 34) may not be folded. Instead, one eye (e.g., the eye 42) provides the load portion 14, and the other eye (e.g., the eye 46) provides the lifting portion 18. In such a construction, the one eye 42 providing the load portion 14 is centered on the connection point C of the load L. With a folded second sling (e.g., the sling 38), one eye 42, 46 of the sling 38 is on each side of the one eye 42 of the sling 34.

Figure 7:
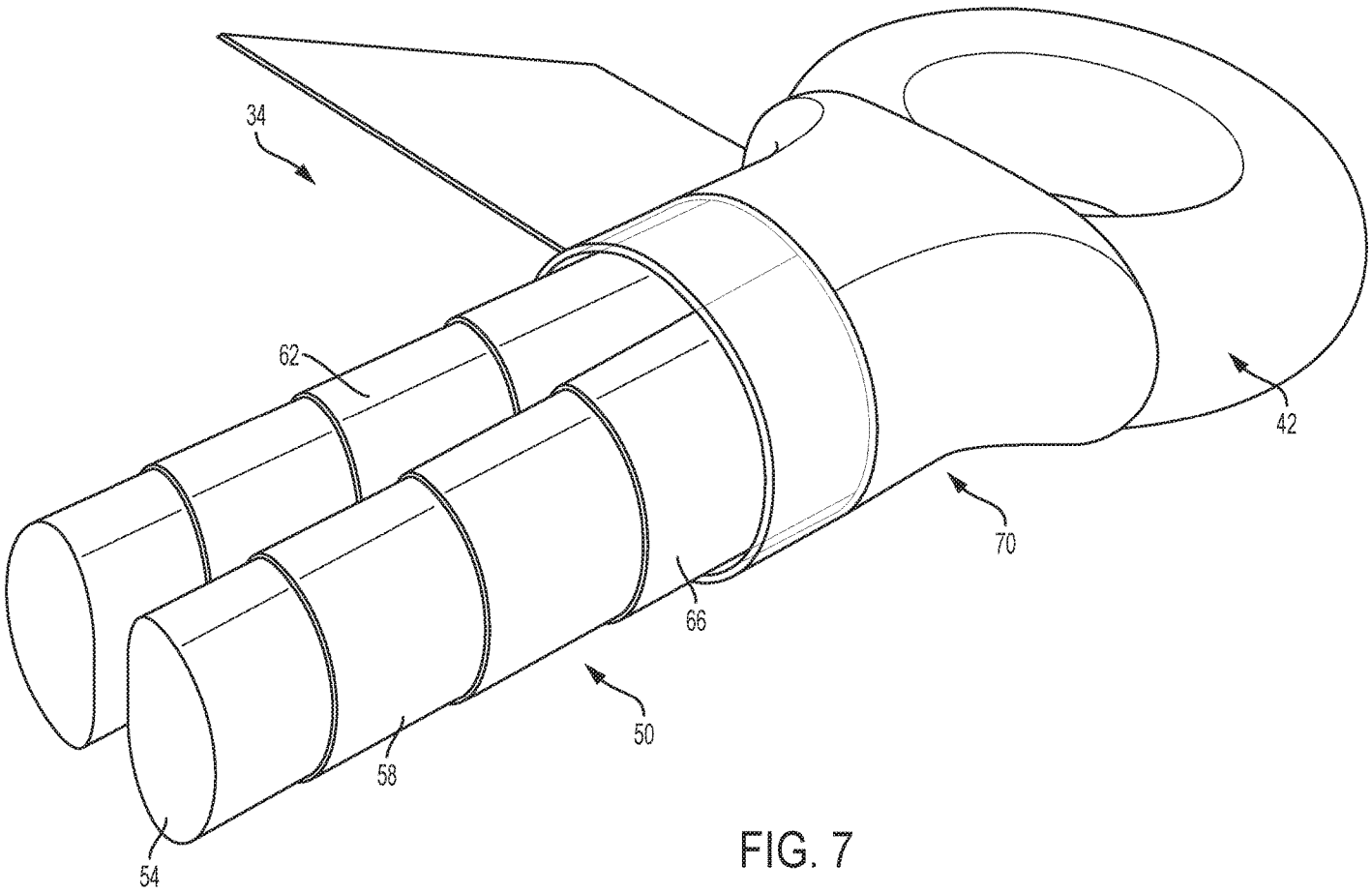
FIG. 7 is a perspective cutaway view of a synthetic sling of the assembly shown in FIG. 3.
Figure 8:
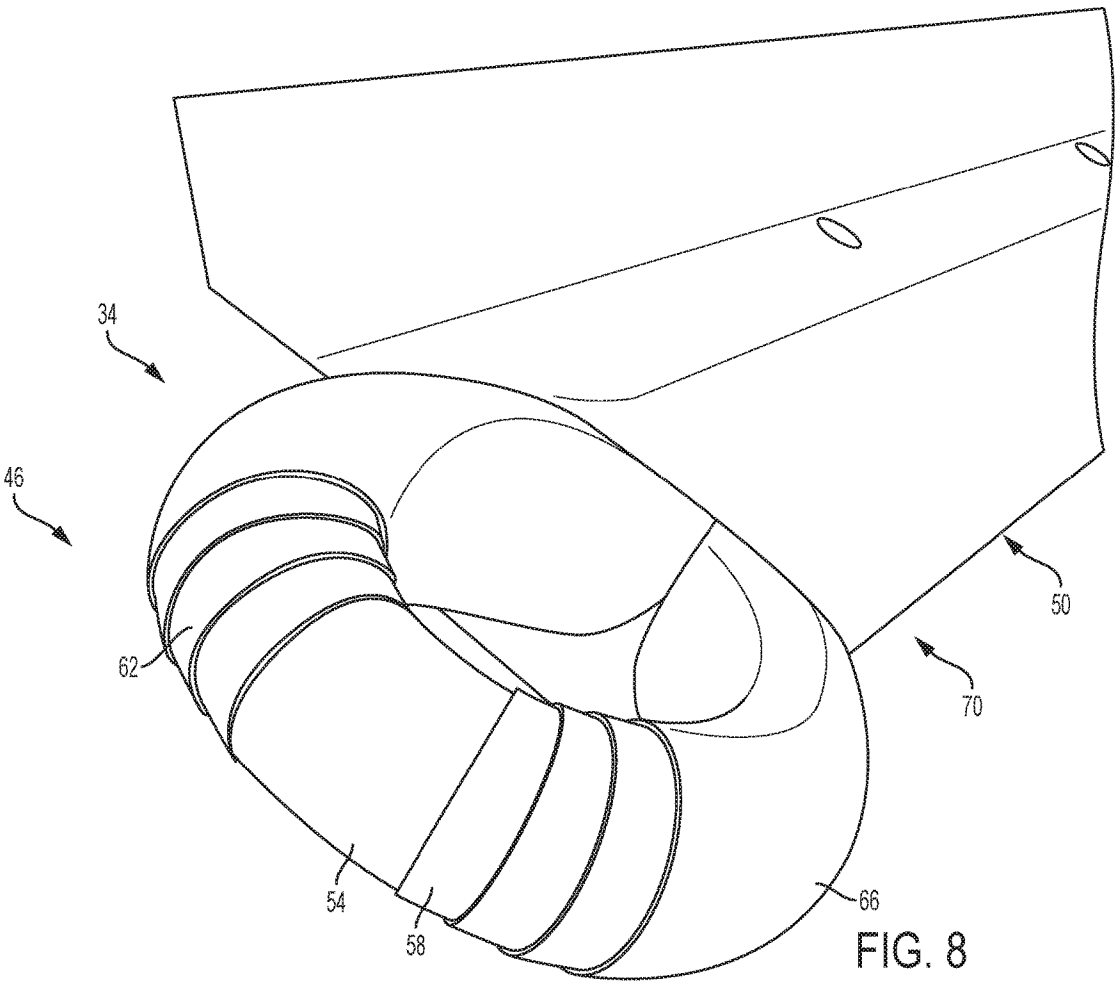
FIG. 8 is a perspective cutaway view of an eye of the sling shown in FIG. 7.
Figure 9:
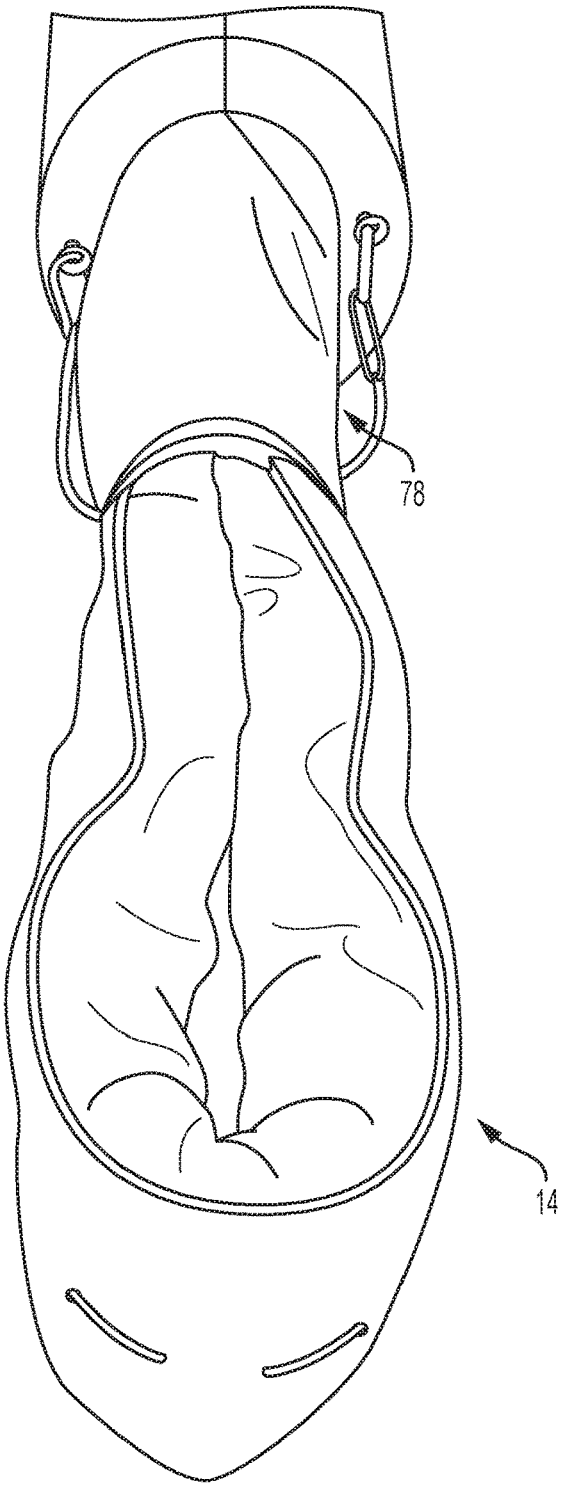
FIG. 9 is a perspective view of a load eye of the assembly of FIG. 3.

FIGS. 7-8 illustrate the construction of a sling (e.g., the sling 34) in more detail. The illustrated sling 34 is a round Selantic sling (a.k.a., an endless grommet sling) available from the Cortland Company. Selantic Slings are generally made from Aramid and HMPE fibers (e.g., Twaron® and Dyneema®), in an "endless loop" construction, and encased in multiple layers of laminated and PU-coated Cordura® jackets. The illustrated sling 34 is formed of a load bearing fiber 54 (e.g., high modulus polyethylene (HMPE; Dyneema® SK78 available from DSM N.V.)). The fiber 54 is surrounded by one or more layers (e.g., a polyethylene (PE) filter liner 58, a silicon-coated polyamide inner chafe protection 62, HMPE eye protection 66 and chafe protection 70). The chafe protection 70 may be cut resistant and removable. In the illustrated construction, the other sling (e.g., the sling 38) has generally the same construction (e.g., a round Selantic sling).

A Selantic round sling (which can be fabricated in a shorter length than a traditional sling) can be used to deliver a very short/very strong sling for applications in which hook height may be an issue. However, the length can be tailored to accommodate longer requirements as well.

Figure 10:
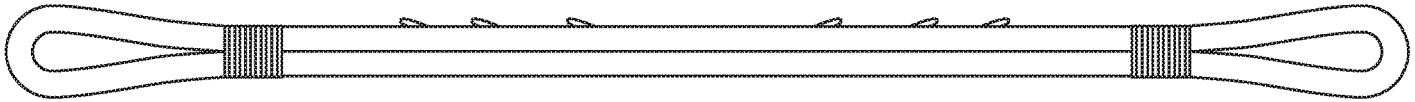
FIGS. 10-12 illustrate exemplary slings for the assembly.
Figure 11:
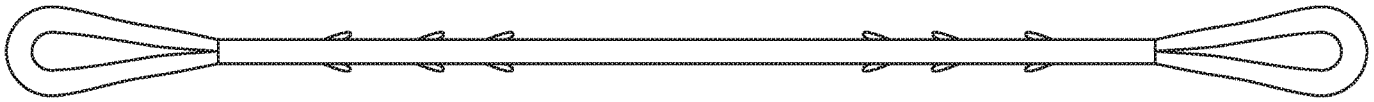
Figure 12:
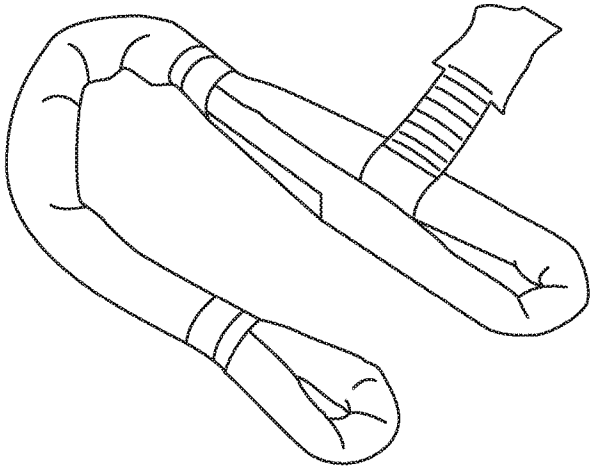

In other constructions, the sling(s) 34, 38 may include a rope sling. The rope sling may be formed of braided rope (e.g., double strand, 3-strand, 5-strand, 8-strand, 12-strand, etc.), laid rope (e.g., wire-laid, parallel-laid, 3-strand laid, 7-strand, etc.) or another type of rope. The rope sling may include a round sling (see FIG. 10) or an eye-and-eye sling (see FIG. 11).

The rope sling may include a 12×12 (or other braid pattern (e.g., 12×3, 12×8, etc.)) rope sling formed of Plasma® available from Cortland. The illustrated 12×12 rope sling is a 12-strand braided rope in which each of the 12 strands is, in turn, a 12-strand rope, or braided primary strand. Plasma® is manufactured from HMPE enhanced by a recrystallization process. The Plasma® 12×12 rope sling may include a standard polyurethane finish or other coating based on the application. The structure of the rope sling may be similar to that described and illustrated in U.S. Pat. No. 5,901,632, the entire contents of which is hereby incorporated by reference.

The Plasma® 12×12 rope sling can be used when a longer sling is desired to lower the structure out of the splash zone where max dynamic loading occurs (e.g., because the crane block should not get wet). One construction could be a hybrid solution incorporating both a Plasma® rope sling and a Selantic sling. These slings are compatible with standard subsea lifting/rigging equipment used for load transfer. The slings may provide a reliable, lightweight, flexible, easy to handle and cost effective alternative to heavy chains and wire rope.

In other constructions (not shown), each sling 34, 38 may have a different constructions. For example, one sling (e.g., the sling 34) may be a round sling (as discussed above; see FIGS. 7-8 and 10), and the other sling (e.g., the sling 38) may have an eye-and-eye construction (see FIG. 11). The slings 34, 38 may be formed of the same or different materials. Also, the slings 34, 38 may be substantially the same size (e.g., length) or different sizes. The type, material, size, etc. of the slings 34, 38 may be selected based on the application(s) for the assembly 10.

The illustrated slings 34, 38 are bound together by a connection 74. In the illustrated construction, the connection 74 includes a cover 78 encompassing the load portion 14 (e.g., the portion provided by each sling 34, 38) such that the load portion 14 appears to be a single connection location or eye. The cover 78 also encompasses a portion of the load bearing portions 26, 30. The illustrated cover 78 is formed of friction resistant nylon (e.g., Cordura® available from Invista) and may be fluorescent for the subsea application. In the illustrated construction, the connection 74 also includes a whipping or seizing 82 connecting the load bearing portions 26, 30.

In other constructions (not shown), the connection 74 may include a cover 78 only covering the load portion 14. In other constructions (not shown), the connection 74 may include only the cover 78 or the whipping/seizing 82.

The sling(s) 34, 38 may comprise materials such as, without limitation, ultra high molecular weight polyethylene (UHMWPE)-based materials such as low-friction UHMWPE (for example, Dyneema Purity® UHMWPE available from DSM N.V., Spectra® 900 and Spectra® 1000 available from Honeywell International, Inc., or Endumax® available from Teijin Aramid B.V.), a recrystallized high modulus polyethylene (HMPE; for example, Plasma® available from the Cortland Company), a liquid crystal polyester (LCP; for example, Vectran® available from Kuraray Co.), a gel-spun polyethylene (for example, Spectra® available from Honeywell International, Inc.), a para-aramid (for example, Twaron® available from Teijin Aramid B.V. or Kevlar® available from DuPont), a para-aramid copolymer (for example, Technora® available from Teijin Aramid B.V.), a polyamide (nylon), a polyester, etc. or combinations thereof.

HMPE fibers (e.g., Plasma®, Dyneema®, Spectra®) are high-modulus polyethylene fibers produced by gel-spinning ultra-high molecular weight polyethylene (UHMWPE). These fibers may be used for lifting slings (such as the slings 34, 38) because of their outstanding performance in load sharing, wear characteristics and fatigue properties. For subsea installation slings (such as the slings 34, 38), HMPE may be attractive due to its specific gravity less than 1.0.

Unique properties and the distinct chemical composition of Aramid fibers (e.g., Technora®, Twaron®, Kevlar®) may distinguish these fibers from other commercially-available, man-made fibers. Aramid fibers offer the unique combination of high strength, high modulus, toughness and thermal stability. Aramid may be a preferred choice as a load bearing material for applications that should take static loads for longer times and in applications in which temperature is or may be an issue.

A blend of Aramid and HMPE may be used in applications needing sling properties between those offered for pure Aramid or pure HMPE. The blend of Aramid and HMPE can result in high strength, low stretch and ultra-low creep properties to maximize durability in specific situations.

Figure 6A:
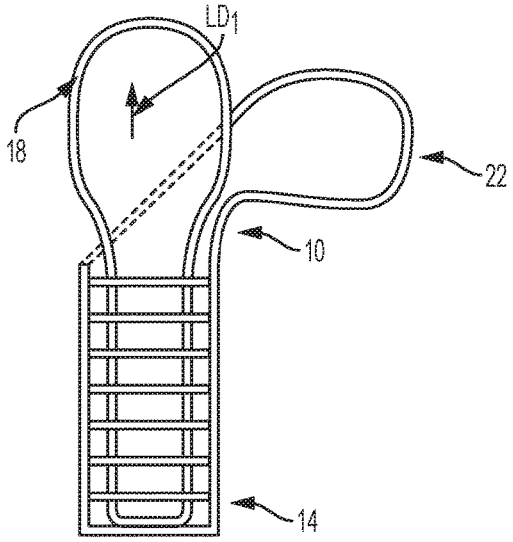
FIGS. 6A-6D are schematic views of a synthetic load transfer assembly and illustrate a load transfer operation.
Figure 6B:
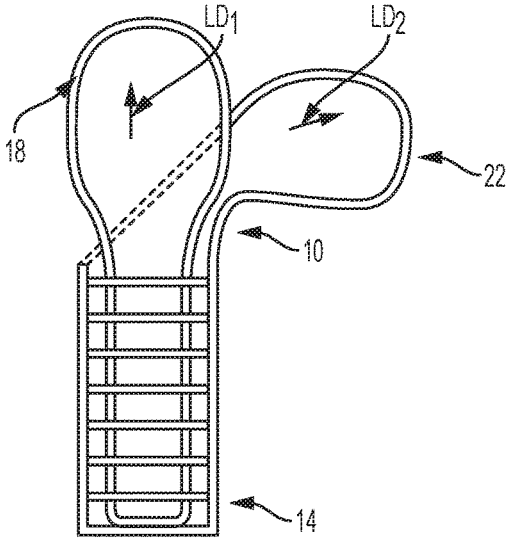
Figure 6C:
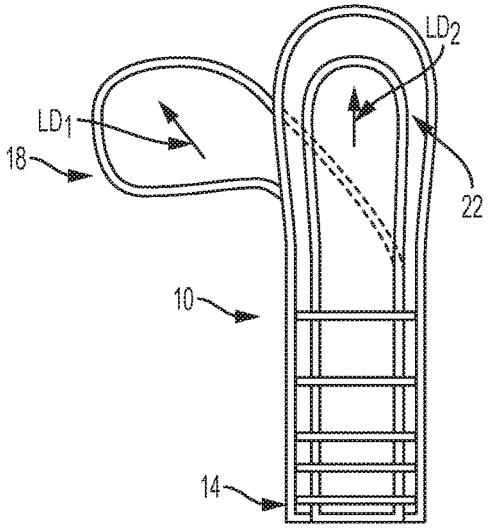
Figure 6D:
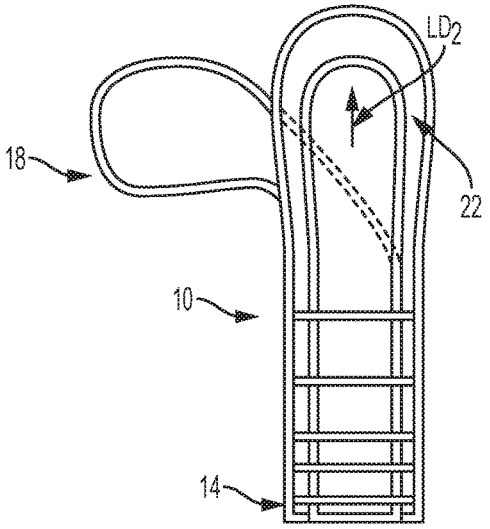

FIGS. 6A-6D illustrate a load transfer operation. As shown in FIG. 6A, the assembly 10 is connected to the first lifting device $LD_1$ at the lifting portion 18 of the sling 34. As shown in FIG. 6B, the second lifting device $LD_2$ engages the lifting portion 22 of the sling 38. The load is then transferred to the second sling 38 (see FIG. 6C), after which the first lifting device $LD_1$ is disengaged from the lifting portion 18 of the sling 34. The load transfer operation may be between a vessel and another structure (e.g., a production system), vessel-to-vessel, structure-to-structure, or between different lifting devices (e.g., winches) on a single vessel or structure.

The illustrated assembly 10 may provide a turnkey product that performs subsea load transfer while, for example, eliminating steel components, additional slings, and/or decreasing hook height. The assembly 10 may be lightweight, easy to handle, less expensive, etc., especially compared to traditional load transfer rigging. The assembly 10 may be used in applications such as, for example, PLETs, PLEMs, PILEs, manifolds, and riser pull-ins.

In the illustrated construction, each sling 34, 38 is designed to take the full load of the lift. Also, each sling 34, 38 can be sized accordingly if max dynamic loading changes after transfer (e.g., 100 te through splash zone; 50 te to sea bed). With the assembly 10, hook height limitations present in offshore lifting can be virtually eliminated.

The assembly 10 may have a maximum breaking load of up to 2,000 metric tons (tonne; te) or more (2,500 te). The assembly 10 may have a suitable Factor of Safety ("FoS") of, for example, 3 to 10. The illustrated slings 34, 38 have lengths as small as 0.8 m up to 150 m or more. ROV activated hardware (not shown) is connected to the eyes.

It should be understood that, in other constructions and/or for other applications, the assembly 10 may have a different construction to withstand different loads (higher or lower or with a different FoS) or different conditions (e.g., time submerged, depth, subsea conditions, etc.). It should also be understood that, in other constructions and/or for different applications, the slings 34, 38 may each be shorter or longer or may be the same length.

One or more independent features and independent advantages of the invention may be set forth in the following claims:

What is claimed is:

1. A synthetic load transfer sling assembly comprising:
- a synthetic first sling including
  - a first load portion directly connectable to a connection point of a load,
  - a first lifting portion directly connectable to a first lifting device, and
  - a first load bearing portion connected between the first load portion and the first lifting portion; and
- a synthetic second sling including
  - a second load portion directly connectable to the connection portion of the load,
  - a second lifting portion directly connectable to a second lifting device, and
  - a second load bearing portion connected between the second load portion and the second lifting portion;
  - wherein the first sling includes a first eye, a second eye, and a leg connected between the first eye and the second eye, the first sling being folded with the first eye and the second eye providing one of the first lifting portion and the first load portion and the leg providing the other of the first lifting portion and the first load portion;
  - wherein the second sling includes a first eye, a second eye, and a leg connected between the first eye and the second eye, the second sling not being folded with the first eye of the second sling providing the second lifting portion and the second eye of the second sling providing the second load portion; and wherein the first load portion and the second load portion are both centered on the connection point of the load.

2. The assembly of claim 1, wherein the first sling and the second sling are each formed of a synthetic material including one of an ultra-high molecular weight polyethylene, a recrystallized high modulus polyethylene, a liquid crystal polyester, a gel-spun polyethylene, a para-aramid, a para-aramid copolymer, a polyamide, polyester, or combinations thereof.

3. The assembly of claim 2, wherein the first sling and the second sling are formed of the same synthetic materials.

4. The assembly of claim 2, wherein the first sling and the second sling are formed of different synthetic materials.

5. The assembly of claim 1, wherein at least one of the first sling and the second sling includes a round sling.

6. The assembly of claim 5, wherein each of the first sling and the second sling includes a round sling.

7. The assembly of claim 1, wherein at least one of the first sling and the second sling includes an eye-and-eye sling.

8. The assembly of claim 7, wherein each of the first sling and the second sling includes an eye-and-eye sling.

9. The assembly of claim 1, wherein the first sling and the second sling are connected.

10. The assembly of claim 9, further comprising a cover encompassing an associated portion of the load portion of the first sling and of the second sling.

11. The assembly of claim 10, wherein the cover encompasses at least a portion of the first load bearing portion and of the second load bearing portion.

12. The assembly of claim 9, further comprising a whipping connecting the first load bearing portion and the second load bearing portion.

13. The assembly of claim 1, wherein the assembly substantially does not include any metallic material bearing a portion of the load.

14. A synthetic load transfer sling assembly comprising:

a synthetic first sling including a first load portion directly connectable to a connection point of a load, a first lifting portion directly connectable to a first lifting device, and a first load bearing portion connected between the first load portion and the first lifting portion; and a synthetic second sling including a first eye, a second eye, and a leg connected between the first eye and the second eye, the second sling including a second load portion directly connectable to the connection portion of the load, the first eye and the second eye of the second sling providing the second load portion, a second lifting portion directly connectable to a second lifting device, an intermediate portion of the leg providing the second lifting portion, and a second load bearing portion connected between the second load portion and the second lifting portion;

wherein the first load portion and second load portion are both centered on the connection point of the load, the first eye of the second load portion being on one side of the first load portion and the second eye of the second load portion being on the other side of the first load portion.

15. The assembly of claim 14, wherein the first sling is folded, and the second sling is not folded.

16. The assembly of claim 14, wherein the first sling and second sling are both folded.

17. The assembly of claim 16, wherein the first sling includes a first eye, a second eye, and a leg connected between the first eye and the second eye, the first eye and the second eye of the first sling providing the first load portion, the first eye and the second eye of the first sling being between the first eye and the second eye of the second sling.

* * * * *